US005983776A

United States Patent [19]

Hansell

[11] Patent Number: 5,983,776

[45] Date of Patent: Nov. 16, 1999

[54] TWO-PIECE SLIPPER WITH BALANCED RUNNING FACE

[75] Inventor: Jeffrey C. Hansell, Ames, Iowa

[73] Assignee: Sauer Inc., Ames, Iowa

[21] Appl. No.: 09/198,664

[22] Filed: Nov. 23, 1998

[51] Int. Cl.[6] ..... F01B 13/04

[52] U.S. Cl. ..... 92/12.2; 92/57; 92/71; 417/269

[58] Field of Search ..... 417/269; 92/12.2, 92/57, 71

[56] References Cited

U.S. PATENT DOCUMENTS

| | | | |
|---|---|---|---|
| 4,495,855 | 1/1985 | Murakami et al. | 92/71 |
| 4,776,260 | 10/1988 | Vincze | 417/269 X |
| 5,794,515 | 8/1998 | Bethke | 92/12.2 X |

FOREIGN PATENT DOCUMENTS

| | | | |
|---|---|---|---|
| 557371 | 5/1957 | Belgium | 92/71 |
| 93/01349 | 5/1993 | WIPO | 417/269 |

*Primary Examiner*—Hoang Nguyen
*Attorney, Agent, or Firm*—Zarley, McKee, Thomte, Voorhees & Sease

[57] ABSTRACT

A hydraulic slipper includes a slipper body having first and second ends and a central portion therebetween. The first end terminates in a spherical-shaped head. The second end terminates in a round base portion with a hub protruding outwardly therefrom in the direction away from the head. The hub terminates in a planar surface and has a diameter less than the diameter of the round base portion. The slipper includes a washer element having a center opening extending around the hub and having first and second opposite planar surfaces. The first surface engages the base portion, and the second surface extends beyond the planar surface of the hub to create a running face for the slipper. The washer element can be a bi-metal ring formed of steel and bronze.

8 Claims, 3 Drawing Sheets

TWO-PIECE SLIPPER WITH BALANCED RUNNING FACE

BACKGROUND OF THE INVENTION

The present invention relates to the field of hydraulic pumps and motors. More particularly, this invention relates to a multi-piece slipper assembly with a balanced running face. Such slippers have a combination of fatigue strength and mechanical properties which leads to longer life for hydraulic pumps and motors. The invention is useful on axial piston hydrostatic units having slippers with male or female connecting ends.

The fatigue strength of the slippers is a limiting factor in the useful life of hydraulic or hydrostatic pumps and motors. Various materials and combinations of materials have been tried on slippers. However, materials which have adequate fatigue strength do not generally have mechanical properties which are appropriate for the running surface for the slipper. Materials that have good characteristics for a running face generally do not have adequate fatigue strength to provide the desired slipper life.

Bi-metal slippers of different configurations have been tried, but they have high manufacturing costs because they have to be manufactured from pieces of raw material and cannot utilize screw machinery technology. The running face material, usually bronze, is sintered or cast onto steel. Thus, there is a need for a multi-piece slipper assembly which has the desired material characteristics and enables cost-effective, high-volume manufacturing processes to be utilized.

A primary objective of the present invention is the provision of a multi-piece slipper which yields acceptable life and is economical to produce.

A further objective of the present invention is the provision of a two-piece slipper assembly which has a support body of high-strength material and a running face washer attachable and retainable on the support body.

A further objective of the present invention is the provision of a bi-metal running face washer which can be produced by a stamping process.

A further objective of the present invention is the provision of a running face washer which is hydrostatically balanced on the slipper body.

A further objective of the present invention is the provision of a washer which is mechanically self-retaining and will be further retained by normal forces present within the hydrostatic unit during operation.

A further objective of the present invention is the provision of a running face washer which can be replaced at intervals to extend the life of the hydrostatic unit.

A further objective of the present invention is the provision of a slipper and washer combination which is easy to assemble, as well as reliable and durable in use.

These and other objectives will be apparent from the drawings, as well as from the description and claims which follow.

SUMMARY OF THE INVENTION

The present invention relates to a hydraulic slipper. The slipper includes a slipper body having first and second ends and a central stem portion. The first end terminates in a spherical-shaped head or male ball end. The second end terminates in a round base portion with a hub or pilot diameter protruding outwardly therefrom in the direction away from the head. The hub terminates in a planar surface and has a diameter less than the diameter of the round base portion. The slipper includes a washer element having a center opening extending around the hub and having first and second opposite planar surfaces. The first surface engages the base portion, and the second surface extends beyond the planar surface of the hub to create a running face for the slipper. The washer element can be a bi-metal ring formed of steel and bronze.

DETAILED DESCRIPTION OF THE PREFERRED EMBODIMENT

Figure 1:
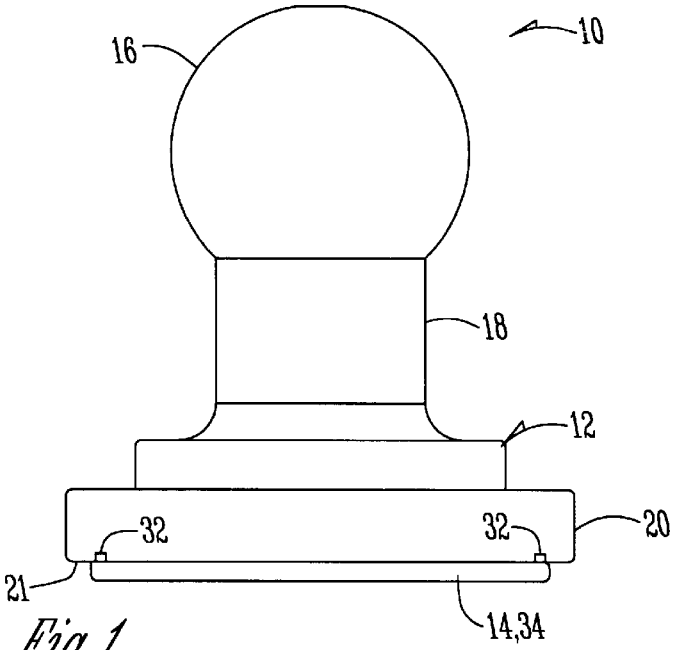
FIG. 1 is a front elevation view of the multi-piece slipper assembly of the present invention.

The hydraulic slipper assembly of this invention is generally designated by the reference numeral 10 in the figures. In FIG. 1, the slipper assembly 10 includes a slipper body 12 and a washer element 14 detachably mounted thereto. The slipper body 12 has a first end terminating in a spherical-shaped head or ball portion 16 which conventionally attaches to one of the pistons (not shown) in an axial piston hydraulic or hydrostatic unit, such as a pump or motor. A central portion or stem portion 18 connects the ball portion 16 to the second end or lower portion 20 of the slipper.

Figure 2:
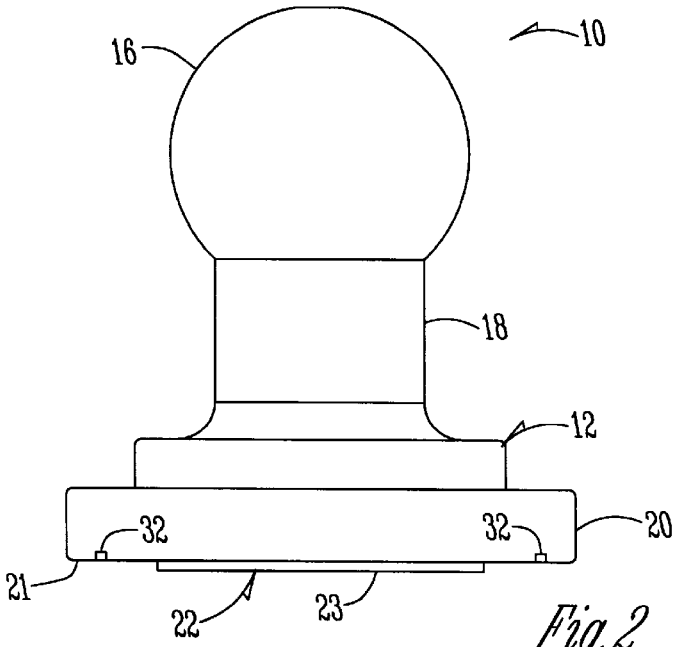
FIG. 2 is a front elevation view of the slipper body of the slipper assembly shown in FIG. 1.
Figure 3:
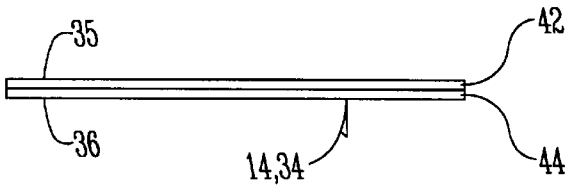
FIG. 3 is a front elevation view of the bi-metal running face washer of the slipper assembly shown in FIG. 1.
Figure 4:
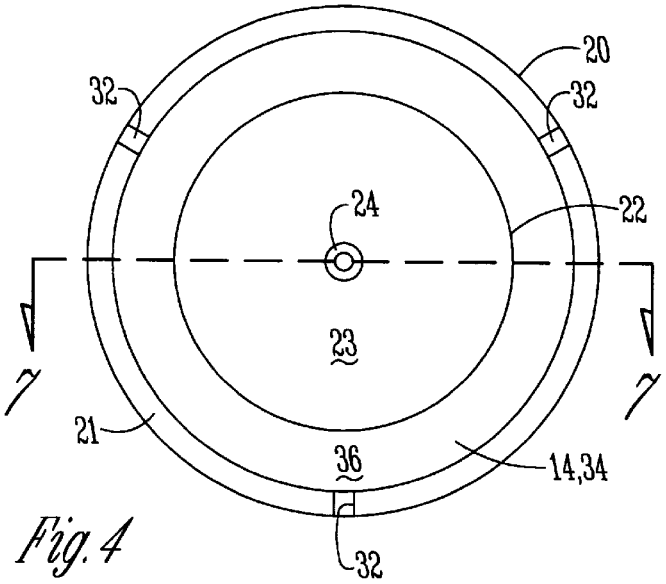
FIG. 4 is a bottom plan view of the slipper assembly of FIG. 1 and shows the running face of the washer.
Figure 5:
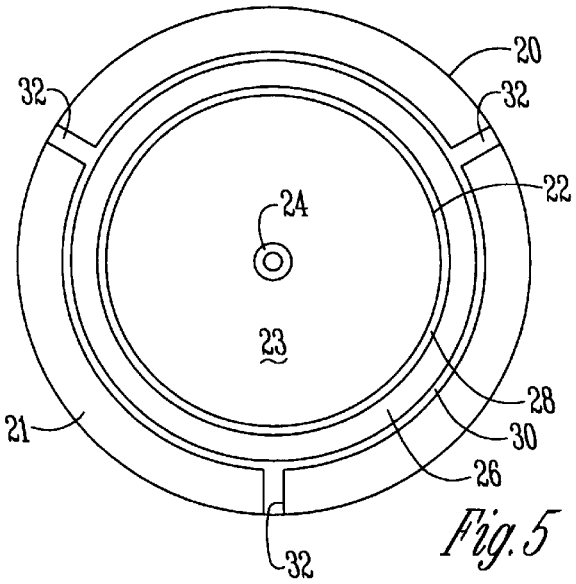
FIG. 5 is a bottom plan view of the slipper body of FIG. 2.
Figure 6:
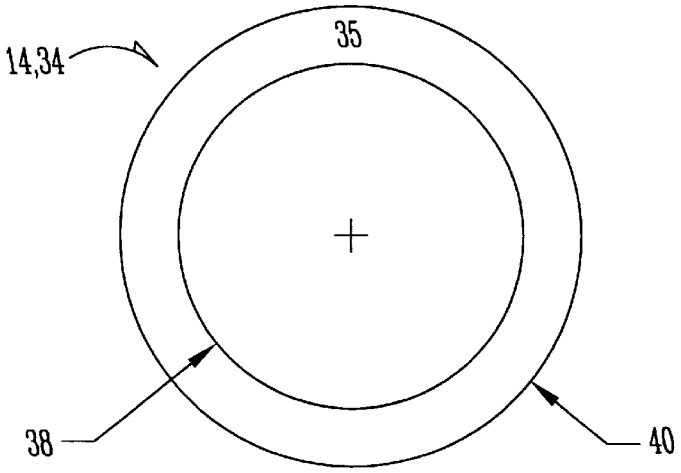
FIG. 6 is a bottom plan view of the bi-metal washer shown in FIG. 3.
Figure 7:
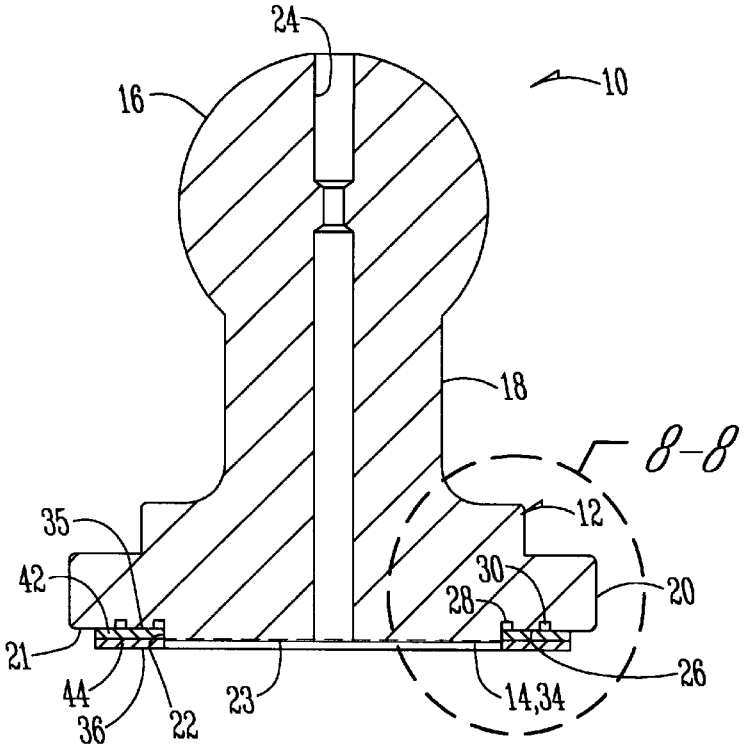
FIG. 7 is a cross-sectional view of the slipper assembly taken along line 7—7 in FIG. 4.

As best seen in FIGS. 2, 4 and 6, the second end 20 of the slipper body 12 terminates in a round base portion 21 and includes a thin hub 22. The round base portion 21 preferably has a diameter greater than the diameter of the head 16. The hub 22 protrudes outwardly in a direction away from the head 16 and terminates in a planar surface 23. The hub 22 has a diameter less than the diameter of the round base portion 21. A small, high-pressure fluid passageway 24 extends through the slipper body 12 from the head 16 to the central portion of the hub 22, as shown in FIGS. 4 and 6.

Figure 8:
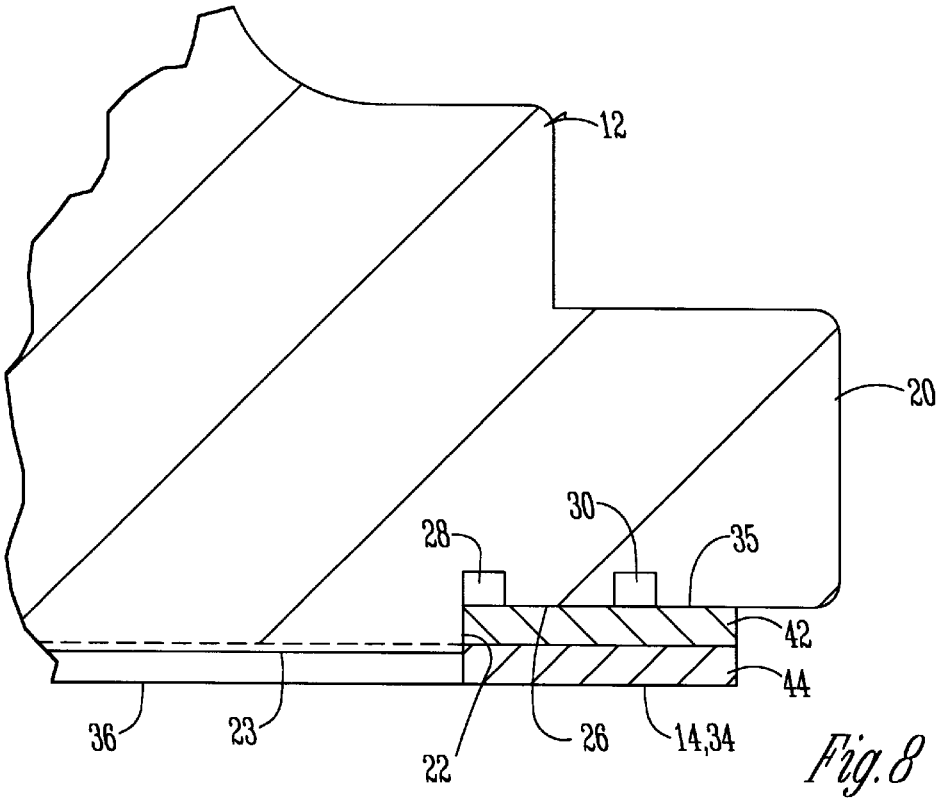
FIG. 8 is an enlarged and fragmented cross-sectional view of the assembly of FIG. 1 and shows the fit of the bi-metal washer to the slipper body.

Referring to FIGS. 6 and 8, the round base portion 21 of the slipper body 12 has a balance land 26 thereon defined by two concentric annular grooves 28, 30 which extend around the hub 22. One or more radially extending drain grooves 32 are provided to fluidly connect the outer groove 30 with the outer diameter of the round base portion 21. The drain grooves 32 allow any fluid trapped in the groove 30 to be drained to the case of the hydraulic unit.

The other major component of the multi-piece slipper assembly 10 is a washer element 14. Referring to FIGS. 3 and 6–8, the washer element 14 is preferably a bi-metal washer 34 which has first and second planar surfaces 35, 36. The first surface 35 abuts the round base portion 21 adjacent the hub 22. The washer 34 has a thickness greater than the height of the hub 22 so that the second planar surface 36 of the washer 34 constitutes an elevated running face or wear surface 36 for the slipper assembly 10. The washer 34 is preferably a substantially flat ring having an inside diameter or center opening 38 and an outside diameter 40. The outside diameter 40 of the washer 34 is preferably smaller than the largest diameter of the support portion 20 so that the washer is substantially supported across its entire width by the round base portion 21. The inside diameter 38 of the washer 34 is small enough to provide a tight interference fit with the hub 22 of the slipper body 12. Thus, the washer 34 is detachably mounted to and mechanically self-retained on the slipper body 12. The grooves 28 and 30 further help retain the washer 34 by hydrostatically balancing it. The forces on the wear surface 36 are hydrostatically balanced with opposing forces on the first surface 35 from the oil in the balance grooves 28, 30.

Preferably the washer 34 is stamped or otherwise fabricated from a bi-metal plate. The bi-metal washer 34 includes a steel layer 42 for support and a bronze metallic layer 44 sintered or cast directly onto the steel layer 42. The metallic layers 42, 44 are structurally bonded together to form an integral washer 34. The bi-metal washer 34 thus includes a bronze layer 44 which provides good mechanical characteristics for the running face and a steel layer which provides adequate fatigue strength and support for the bronze layer 44. Preferably the upper surface of the layer 44 is located below the planar surface 23. This ensures that the bronze layer 44 will always be the material the slipper assembly 10 runs on, and not the material of the slipper hub 22. Furthermore, the slipper body 12 can also be constructed of high-strength material, including but not limited to steel. The relatively small thickness of the washer 34 allows it to be fabricated using conventional and cost-effective processes such as stamping. The washer 34 can also be formed in one piece from solid brass or bronze if the fatigue life of the material is within acceptable limits for the particular application.

Although the slipper assembly shown has a head or male connection means for attaching to a hydraulic piston, this invention is also applicable to slipper assemblies having female connection means such as a socket.

Therefore, it can be seen that the invention at least achieves its stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention.

What is claimed is:

1. A hydraulic slipper, comprising:

a slipper body having first and second ends, and a central portion, the first end terminating in a spherical-shaped head, the second end terminating in a round base portion with a thin hub protruding outwardly therefrom in a direction away from the head, the hub terminating in a planar surface and having a diameter less than the diameter of the round base portion, a washer element having a center opening extending around the hub and having first and second opposite planar surfaces extending generally transverse to the center opening, the first surface engaging the base portion, and the second surface extending beyond the planar surface of the hub to create a transverse annular and planar running face for the slipper.

2. The hydraulic slipper of claim 1 wherein the washer element is comprised of a first metallic layer comprising the first surface of the washer, and a second metallic layer comprising the second surface and running face of the washer.

3. The hydraulic slipper of claim 2 wherein the first and second metallic layers are comprised of steel and bronze, respectively.

4. The hydraulic slipper of claim 2 wherein both metallic layers of the washer extend around the hub.

5. The hydraulic slipper of claim 4 wherein the second metallic layer has an upper surface which extends above the planar surface of the hub.

6. The hydraulic slipper of claim 2 wherein the first and second metallic layers are secured to each other to create a washer element of integral construction.

7. A hydraulic slipper, comprising;

a slipper body having first and second ends, and a central portion, the first end terminating in a spherical-shaped head, the second end terminating in a round base portion with a thin hub protruding outwardly therefrom in a direction away from the head, the hub terminating in a planar surface and having a diameter less than the diameter of the round base portion, a washer element having a center opening extending around the hub and having first and second opposite planar surfaces, the first surface engaging the base portion, and the second surface extending beyond the planar surface of the hub to create a running face for the slipper body;

wherein at least one annular oil groove is located at the base portion adjacent the first surface of the washer element, with the oil groove being intersected by at least one oil drain groove formed in the base portion and extending outwardly to an outer periphery of the washer element.

8. The hydraulic slipper of claim 7 wherein a second annular oil groove is located in the base portion in spaced relation within the first-mentioned annular oil groove.

* * * * *